United States Patent [19]

Dickinson

[11] 4,097,170

[45] Jun. 27, 1978

[54] MODULAR TRAFFIC CONTROLLER

[76] Inventor: Harry D. Dickinson, 1681 Larco Way, Glendale, Calif. 91202

[21] Appl. No.: 769,940

[22] Filed: Feb. 18, 1977

[51] Int. Cl.[2] ..... E01F 13/00

[52] U.S. Cl. ..... 404/6; 404/11; 49/131

[58] Field of Search ..... 404/6, 9, 11, 17; 49/93, 131

[56] References Cited

U.S. PATENT DOCUMENTS

| | | | |
|---|---|---|---|
| 922,165 | 5/1909 | Lee | 404/6 X |
| 1,518,616 | 12/1924 | Varnell | 404/6 X |
| 1,527,107 | 2/1925 | Allen | 404/6 X |
| 1,949,295 | 2/1934 | Dean | 404/11 |
| 1,960,376 | 5/1934 | Gilman | 404/6 |
| 2,403,014 | 7/1946 | Nampa | 49/93 X |
| 3,134,184 | 5/1964 | Neblett | 404/11 X |
| 3,325,782 | 6/1967 | Der | 404/1 X |
| 3,423,780 | 1/1969 | Alten | 404/47 X |

*Primary Examiner*—Nile C. Byers
*Attorney, Agent, or Firm*—William H. Maxwell

[57] ABSTRACT

A visible traffic controller permitting free flow of desired traffic in one direction while preventing reverse flow of undesired traffic in the opposite direction, and comprised of a low profile support or frame superimposed over an unaltered pavement surface and characterized by replaceable barrier modules each having several barrier blades for tire engagement and yieldingly biased for depression by a balancing spring means positioning a trunnion support therefor.

18 Claims, 8 Drawing Figures

MODULAR TRAFFIC CONTROLLER

BACKGROUND

Traffic controllers are utilized as intimidating devices that preclude wrong-way traffic of automobiles at the entrances and exits of parking areas and the like. That is, a visible barrier is presented at the pavement level so as to permit the desired traffic flow by means of its depression when engaged by rolling tires, and so as to cause or likely to cause tire damage to undesired reverse flow traffic by means of its visible configuration of projecting members. In practice, notice in the form of warning signs is posted so as to advise motorists of the consequences to expect in attempting to defeat the barrier; that is, the probability of tire damage when a motorist persists in violating the barrier to ingress or egress established by a proprietor.

Heretofore, traffic directors or controllers of the type under consideration have involved retractile spring arms and spikes assembled as a unit in a frame inset into an excavation below the pavement level. Obviously, the housings of such units must be fabricated to specification in each instance, and the installation site specially prepared with a fitted recess subject to collecting debris and requiring drainage. A general object of this invention is to provide an above-grade traffic controller of low profile which requires no special site preparation and which is not susceptible to the collection of debris and which is self-draining. With the present invention, installation is easily accomplished by using an adhesive and/or lag screws or the like in applying the unit support or frame to a pavement surface, or by welding the same to an existent frame coincidental with the pavement surface. When using an adhesive, the controller can be employed on a temporary basis and broken loose so as to be reinstalled at different locations, as for example to comply with re-routing of traffic at a construction project.

Installation of recessed traffic directors or controllers is difficult if not prohibitive in structures that have pre-stressed slabs of pavement, in that box-shaped recesses present interruptions that break through membranes and weaken said structures. Therefore, it is an object of this invention to provide a superimposed traffic controller devoid of intrusion through membranes and into the supporting slab to which it is applied, and thereby precluding any destruction of seals and weakening of such structure. With the present invention, the pavement structure remains unaltered with the installation of the low profile unit frame superimposed thereover and secured in place as by adhesive and/or hold-down fasteners.

Traffic directors or controllers have been fabricated as units of specified dimensions, and comprised of a multiplicity of springs or spikes separately retractable into a housing in which they are individually secured (as are springs) or gang mounted upon a pivot rod (as are spikes). In any case, the unit fabrications have been comprised of interdependent housing and pivot rod features, and to the end that said unit fabrications must be removed from their installations and/or dismantled as a whole in order to make repair of any one spring or spike. It is an object of this invention to provide for repair without removal of the traffic controller from its installation and without its complete disassembly. With the present invention, there is a construction of depressible blade modules replaceable in a low profile frame that is superimposed upon the pavement over which vehicular traffic is directed. The modules are comprised of like plates through which barrier blades retract against the bias of return means incorporated in the replaceable module; the modules being provided in nominal (one foot) increments and each carrying several barrier blades.

The traffic controller of the present invention is characterized by its modular feature that is adaptable to either an existent and/or abandoned installation or to a new frame. The aforementioned low profile is related to the flat pavement surface over which the barrier modules operate, whether carried gy a ramped frame installed upon virgin pavement, or carried by supports applied to pre-existent frameworks of abandoned units. In practice, pre-existing units of various construction become damaged beyond repair, leaving a frame embedded in the pavement, usually of concrete, so as to present a frame comprised of spaced parallel members flush with the pavement surface; and it is these pre-existent frames to which the support of the present invention can be applied to carry the replaceable and reversible barrier modules. It is an object, therefore, to provide a simple and practical support applicable to a frame flush with the pavement surface for carrying a low profile barrier module. With the present invention, a pair of rails characterize the support and/or frame, as will be described.

In carrying out the present invention, structural unity is in the frame that receives the replaceable modules, and all of which must have durability not subject to deformation in normal usage. It is an object of this invention, therefore, to provide the combination of a support or frame and tire barrier modules that are durable and which remain operational without deformity or undue deflection. Accordingly, space is conserved and the tire supporting beam sections of both the support or frame and said modules are short coupled for maximum strength.

In the event of damage which can occur, it is an object to easily replace only that portion of the traffic controller which becomes deficient. To this end each module is comprised of a mounting plate to which several barrier blades are journaled for extension and retraction in unison by means of a balanced spring return means. With the spring return means herein disclosed, the several barrier blades are held in axial balance so as to revolve freely upon spaced trunnions, and all of which is secured to a support or housed within a shallow frame channel that is self-draining.

SUMMARY:

This invention relates to traffic controllers of the type presenting a visible barrier that is engageable by the tires of a vehicle rolling over or into the same. The barrier is comprised of a transverse series of barrier blades projecting radially from trunnions upon which they revolve between extended and retracted positions. The barrier blades are spring biased to said extended position where they engage stops from which they are depressible to said retracted positions by a tire rolling thereover in a direction away from said stop. However, the barrier blades are also immoveable against a tire rolling thereagainst in a direction opposed to said stop, the blades having points elevated sufficiently to engage the tire periphery at a substantially normal angle adapted to pierce the same when rolling thereof continues in said opposed direction.

In accordance with the first form of this invention as illustrated in FIGS. 1-6 of the drawings, there is a frame F characterized by a ramped-rail configuration of low profile and adapted to be superimposed over a pavement surface to direct traffice, and there is a plurality of barrier modules M adjacently related and replaceably secured to the rails of the frame F. In accordance with the second form of this invention as illustrated in FIGS. 7 and 8 of the drawings, there is a support F2 characterized by its low profile rail configuration adapted to be superimposed over the abandoned frames of other such units that have been gutted and left flush with the pavement to expose the usual recess, and there is a plurality of barrier modules M2 adjacently related and replaceably secured to the rails of the support. Each barrier module M-M2 is comprised of a mounting plate P of nominal (1 foot) length and several barrier blades B rotatable on spaced trunnions T below said plate to be yieldingly urged into engagement with a stop by a balancing spring means S. The structural components and mechanical members are fabricated of steel sections and plates welded together for permanency or screw fastened together for removability, all as hereinafter shown and described.

DRAWINGS:

The various objects and features of this invention will be fully understood from the following detailed description of the typical preferred forms and applications thereof, throughout which description reference is made to the accompanying drawings, in which.

Figure 2:
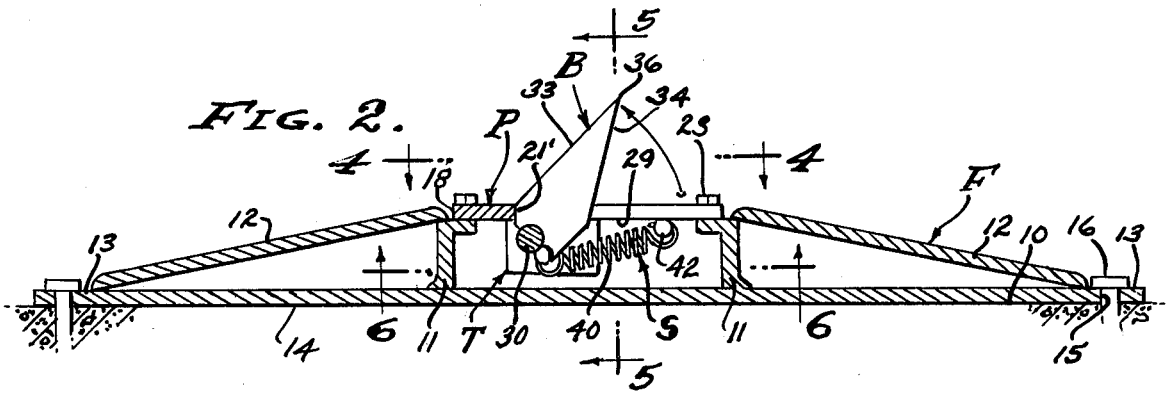
FIG. 2 is an enlarged sectional view taken as indicated by line 2—2 on FIG. 1, illustrating extended barrier blades.
Figure 3:
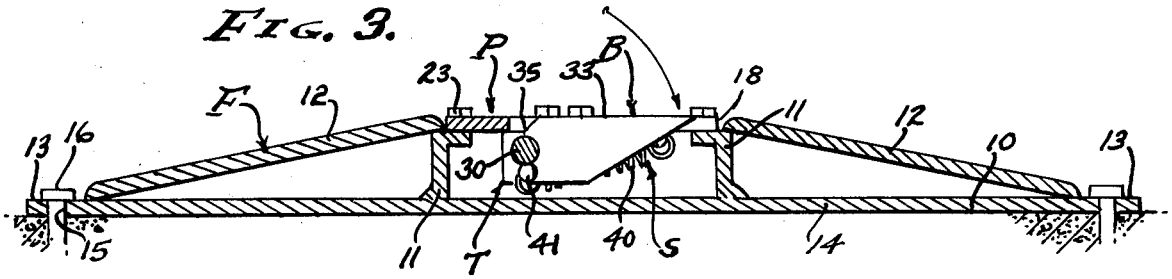
FIG. 3 is a view similar to FIG. 2 illustrating retracted barrier blades.
Figure 4:
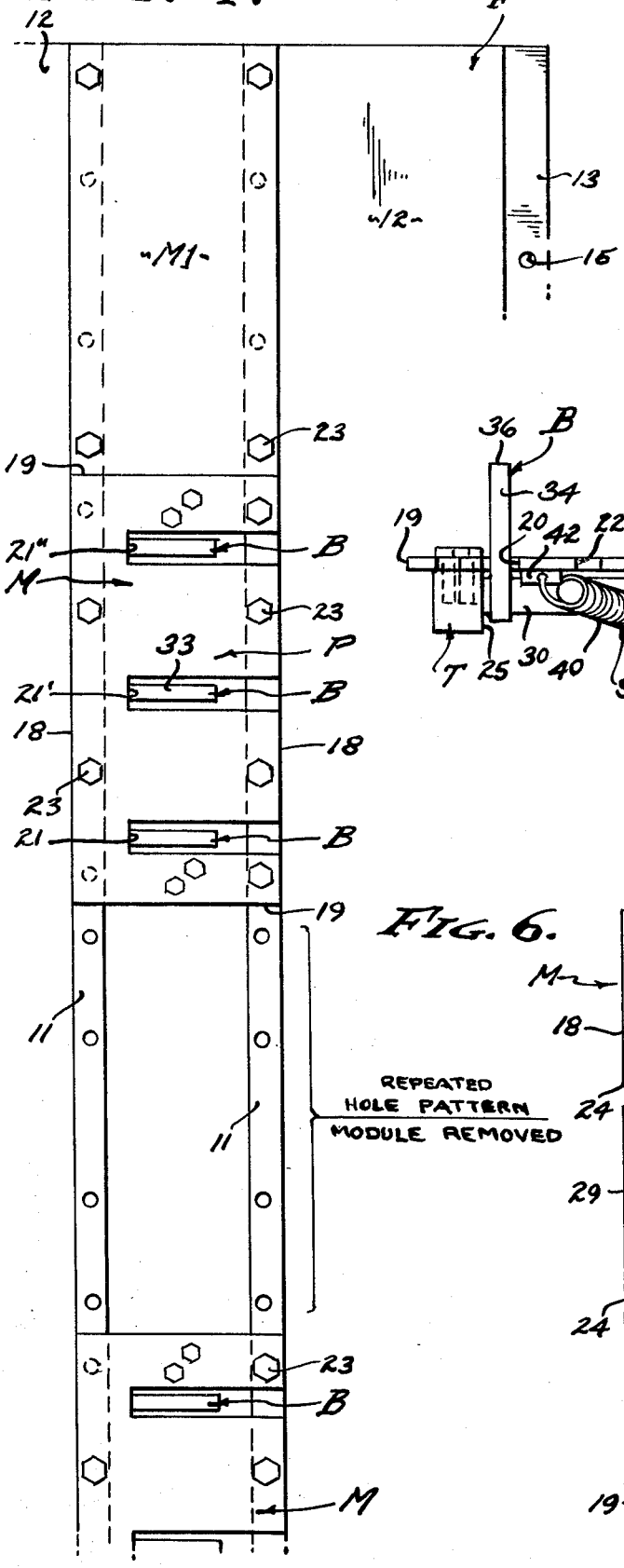
FIG. 4 is a plan view of a portion of the structure with one of said modules removed and taken as indicated by line 4—4 on FIG. 1.
Figure 5:
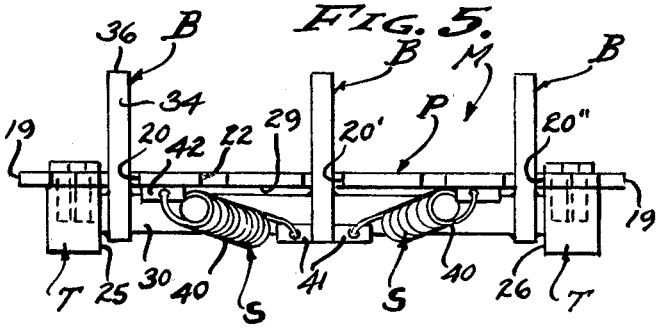
Figure 6:
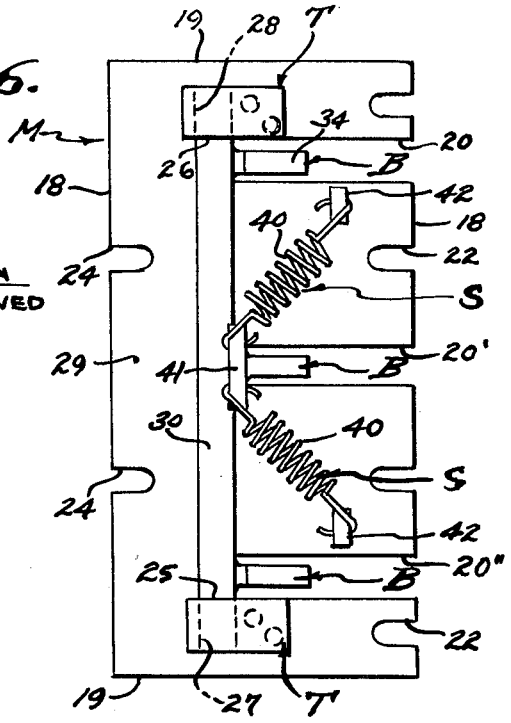

FIGS. 5 and 6 are detailed views of a module removed from the frame and taken as indicated by lines 5—5 and 6—6 on FIG. 2.

Figure 1:
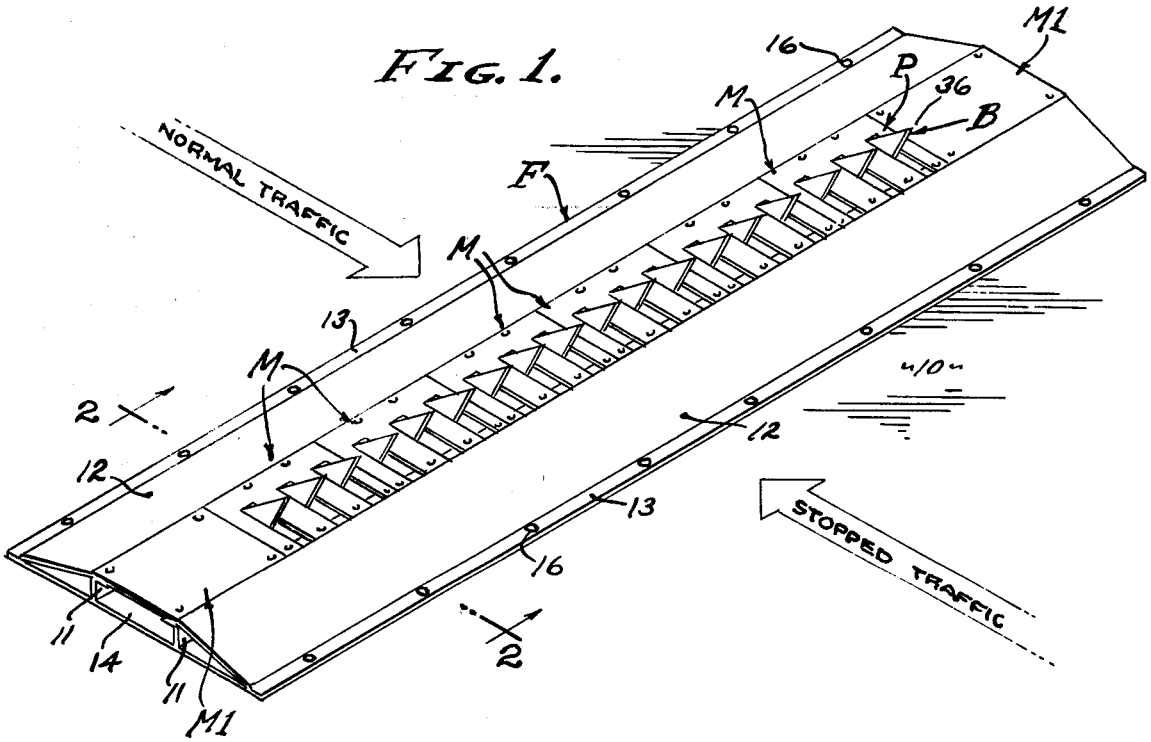
FIG. 1 is a perspective view of the modular above-grade traffic controller of the present invention, in one form thereof involving a low profile frame.
Figure 7:
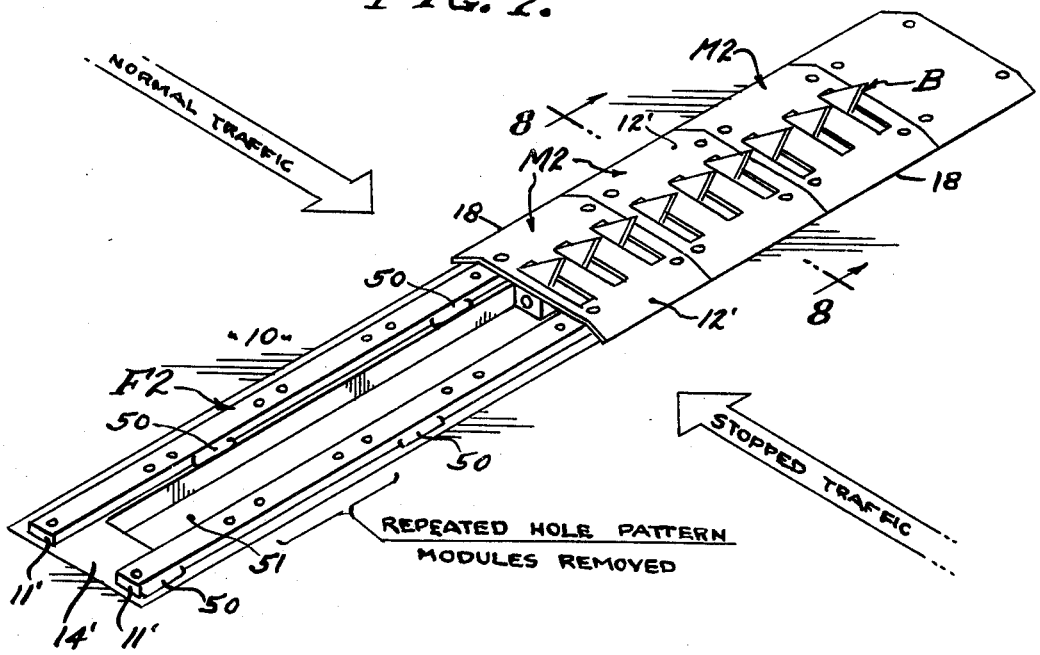
Figure 8:
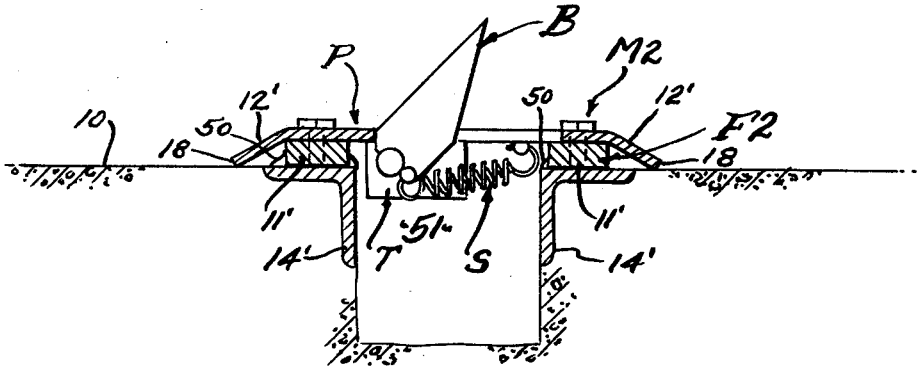

FIG. 7 is a view similar to FIG. 1 illustrating a form of modular above-grade traffic controller involving a support applied to existent framework; and FIG. 8 is an enlarged sectional view taken as indicated by line 8—8 on FIG. 7 and illustrating the barrier blades extended for traffic control.

PREFERRED EMBODIMENT:

Referring now to the drawings, the low profile modular traffic controller of the present invention is adapted for transverse installation across a vehicular driveway or the like, to freely pass vehicle traffic moving in the desired direction and to hinder wrong-way traffic moving in the opposite direction. The traffic controller is an elongated structural unit superimposed over a flat pavement slab 10 to extend transversely of the driveway (not shown) and normal to the direction of traffic flow in either direction.

In accordance with the first form of this invention and as illustrated in FIGS. 1-6 of the drawings, the frame F is a ramped-channel member several feet wide and with spaced and parallel rails 11 to which ramps 12 extend from the opposite margins 13 of a base 14. The rails 11 establish the height of the channel defined thereby to open upwardly. In practice, the ramps and base members 12 and 14 are planar sheet or plate steel of rectangular configuration, and the rise for the opposite inclined planes established by the rail members 11 of angular cross section, as shown. A feature is the horizontally coplanar inturned flanges of the rails 11, and the vertically disposed supporting flanges thereof that carry the ramps 12, and all of which is integrally welded along the edges of joinder. In practice, the rails are of $\frac{3}{4} \times 1\frac{1}{2}$ inch angle with the vertical supporting flanges spaced 6 inches. Fastener openings 15 are spaced along the margins 13 for the reception of hold-down fasteners 16, adhesive being used between the base 14 and pavement surface for securement, all as circumstances require.

In accordance with the second form of this invention and as illustrated in FIGS. 7 and 8 of the drawings, the support F2 comprises a pair of spaced rails 11' secured as by welding 50 to the remaining frame of a previously used controller. It will be understood that other controllers that are in disrepair leave their mark in the pavement surface; namely the usual recess surrounded by a mounting frame 14', usually in the form of an angle iron frame as shown. Within the parallel frame members there is a recess 51, and it is to the top flanges of frame 14' that the bar-like rails 11' are secured by said welding 50, utilizing a jig means (not shown) to ensure parallelism and hole pattern location. As in the first form, there is a distinct hole pattern to receive each barrier module M2, the hole pattern being repeated longitudinally of the rails, for example a simple rectangular hole pattern as clearly shown repeated station to station and to which the modules are secured as shown in FIG. 7.

A plurality of barrier modules M are employed in adjacent relationship for support by the frame F and/or support F2, and to present the barrier blades B in a uniform series spaced longitudinally thereof. A feature of this invention is that the barrier modules are alike and preferably identical so as to be replaceably interchangeable and reversible as well. Another feature is the presentation of a plurality of barrier blades B by each barrier module M, preferably a group of three blades equally spaced with respect to each other and also with respect to the blades of next adjacent barrier modules.

Each barrier module M comprises a rectangular mounting plate P of less than 6 inch width to span the coplanar flanges of the two rails 11 and of 1 foot length in which case there is a center barrier blade B with two side barrier blades B spaced 4 inches therefrom. Accordingly, the mounting plate P has opposite edges 18 and ends 19, and it is slotted normal to one edge 18 at 20, 20', and 20'' to receive the three blades with side and end (point) clearance, the bottoms 21, 21', and 21'' thereof presenting stops for upward positioning of said blades respectively. Each free edge portion of the mounting plate, between the slots and opposite parallel ends thereof is notched at 22 for the reception of a fastener 23, and the opposite parallel edge 18 with a pair of notches 24 complementary to the central pair of notches 22; for reversible securement to the rails 11 and 11' respectively. Accordingly, there is a frame or support station for each barrier module M to be mounted thereon, and each station has a fastener hole pattern in the rails 11 or 11' to accommodate the wide and narrow spacing of said notches 22 and 24, or rectangular hole pattern, as the case may be. That is, there is a uniformly repeated hole pattern in the rails 11 or 11' to secure the fasteners 23 at opposite sides of the mounting plate P.

The spaced trunnions T are provided on an axis of rotation between opposite edges 18, there being a trunnion T depending from the margin of the plate P at each opposite end 19 thereof. As shown, the pair of trunnions are of boss configuration removably screw fastened to the plate P and they present opposed faces 25 and 26 normal to said axis and normal to the plane of plate P. A feature is the pair of journal openings 27 and 28 disposed on said axis of rotation closely spaced, as shown three-eighth inch, below the underside 29 of the said plate. In practice, the base plate or member 14 and mounting plate P are one-quarter inch thick, and it is significant that in the first form of the invention the inside dimensional height of the shallow channel for accommodation of the trunnions T and balancing spring means S is a nominal 1½ inches (the depth of the supporting flanges of rails 11). The low profile of the ramped-channel frame F therefore becomes apparent.

Referring now to the several barrier blades B that are journaled in the trunnions T to operate in unison, there is a mounting bar 30 to which the several blades are attached as an integral assembly. As shown, the mounting bar 30 is a shaft of right cylinder form with its opposite projecting end portions freely rotatable in the journal openings 27 and 28 respectively. The barrier blades B are identical flat triangular members having a base secured to the mounting bar 30 and having front and back faces 33 and 34 for free flow and flow obstruction of traffic respectively. There is a barrier blade B aligned within each slot 20, 20', and 20'', projecting upwardly therethrough to a normally visible position with a stop face 35 thereof simultaneously engaged forwardly against the bottom 21, 21', and 21'' of the said accommodating slots, respectively.

The front face 33 of each barrier blade B is, for example, stopped at a 45° incline, while the back face 34 thereof depends from an apex 36 at a 30° angle with respect to the said front face. Accordingly, the apex 36 is acutely pointed for tire engagement approximately 2 inches above the mounting plate surface. The front face 33 is offset from the mounting bar axis so as to lie coincidental with the mounting plate when depressed. Thus, it will be apparent that the barrier blades B are free to revolve in unison between the extended and retracted positions shown.

The balancing spring means S yieldingly urges the barrier blade-mounting bar assembly into the extended visible barrier position, and is accommodated between the several blades B. In accordance with this invention, the means s comprises a bar of divergent tension springs 40 extending from a lever point 41 at the central blade B to spaced anchors 42 at the underside 29 of the mounting plate P. The lever point 41 is established by lugs offset from the mounting bar axis at the back side thereof, to move approximately 45° forwardly and into a vertical position with respect to the journaled axis when the barrier blades are depressed. And, the anchors 42 are positioned within the flange mounting of the blade B, spaced equally distant from opposite sides of central slot 20'. The springs 40 are of equal length and are hooked under tension to the live and stationary anchor points respectively, thereby drawing the mounting bar 30 into an axially centered position with each barrier blade B centered to move free within its accommodating slot through the mounting plate P.

From the foregoing it will be seen that I have provided an improved traffic controller of modular construction adapted to be selectively employed as circumstances require and adaptable to traffic lane width, to reverse flow of traffic, and to ease of replaceability and repair. The intimidating barrier permits free flow of traffic in one direction and is such as to cause tire damage to traffic flow in the opposite wrong direction. A feature and primary object accomplished thereby is the low profile above-grade capability of the first form of invention herein (FIGS. 1–6) that requires no special excavation or recess, and which is installed over any pre-existent surface without alteration thereto. Secondarily, it is an object accomplished by the second form of invention herein (FIGS. 7 and 8) to utilize pre-existing controller installations that have been abandoned, by securement to the framework left embedded in the pavement, and again which requires no special below-grade preparation. Concurrently with this upon-the-deck feature, building installations upon sealed decks and pre-stressed slabs are made possible, without cutting membranes or into the building structure which would destroy its integrity. In line with these general features, the modular concept is applied for selective utility as to lane width and direction of traffic flow and for the use of cover modules M1 comprised of a replacement plate and devoid of blades B, all as may be required.

The low profile feature dominates the ramped-channel and frame F configuration of the first form of the invention (FIGS. 1–6) and the rails 11 to which the barrier modules M and cover modules M1 are replaceably secured as by screw fasteners or the like. The low profile feature also dominates the support F2 configuration of the second form of the invention (FIGS. 7 and 8) and the rails 11' to which the cover modules M1 and barrier modules M2 are replaceably secured as by means of fasteners. The said second form of barrier module M2 differs from the module M hereinabove described only in its marginal configuration at the opposite edges 18; and accordingly these opposite edges are turned down to form the opposite ramp members 12' extending to the plane of the pavement. It is the low profile channel between the rails 11 and/or 11' that adequately accommodates the depression of the blades B carried in groups of several upon the journaled bar 30 to operate in unison from stops in the plate P that holds them in a visible barrier or fence-like position. The axial position of the mounting bar and blade assembly is established by the spring means S characterized by divergent tension springs of identical configuration which inherently center the bar 30 in the trunnions T and the blades B in their respective slots in the plate P. Thus, it will be apparent that the inventory of parts necessary to construct and to maintain the operable controllers hereinabove described is minimized to the essentials of a frame, and modules comprised of a plate and blade assembly centered therein by a pair of tension springs. Changeability and replaceability is provided for in the screw fasteners as shown.

Having described only the typical preferred forms and applications of my invention, I do not wish to be limited or restricted to the specific details herein set forth, but wish to reserve to myself any modifications or variations that may appear to those skilled in the art:

I claim:

1. An above-grade vehicle traffic controller permitting traffic flow in one direction while preventing traffic flow in the opposite direction, and including:

a low profile support to be transversely superimposed upon a pavement surface over which vehicular traffic is to pass and comprising, a pair of spaced rails secured to said pavement surface, there being an upwardly open channel between said secured rails;

and a plurality of modules selectively replaceable in a series along the rails and including barrier modules comprising, a slotted mounting plate secured to and extending between the rails, a barrier blade assembly journaled on spaced trunnions depending into said channel between the rails and with at least one barrier blade depressible through the mounting plate slotted therefor, and spring means extending from a lever point on the barrier blade assembly to the mounting plate and yieldingly urging the barrier blade assembly into stopped engagement with the mounting plate to be visibly exposed thereabove for vehicle control.

2. The traffic controller as set forth in claim 1, wherein the plurality of selectively replaceable modules includes at least one cover module comprised of a plate secured to the rails in place of the aforesaid barrier modules and extending between the said rails.

3. The traffic controller as set forth in claim 1, wherein each barrier blade assembly comprises a mounting bar rotatable in the said spaced trunnions, and at least one barrier blade carried thereby through the slotted mounting plate.

4. The traffic controller as set forth in claim 1, wherein each barrier blade assembly comprises a mounting bar rotatable in the said spaced trunnions, and at least one barrier blade carried thereby and extending through a complementary slot in the mounting plate and having stopped engagement therein when extended.

5. The traffic controller as set forth in claim 1, wherein the spring means comprises a pair of identical tension springs extending divergently to equidistant anchor points on the mounting plate and thereby positionably balancing the barrier blade assembly axially between the said spaced trunnions.

6. The traffic controller as set forth in claim 1, wherein the barrier blade assembly comprises a mounting bar rotatable in the said spaced trunnions, and several barrier blades carried thereby to extend through complementary slots in the mounting plate, and wherein the spring means comprises a pair of identical tension springs extending diagonally from said lever point at a central barrier blade to equidistant anchor points on the mounting plate and thereby positionably balancing the barrier assembly axially between said spaced trunnions.

7. An above-grade vehicle traffic controller permitting traffic flow in one direction while preventing traffic flow in the opposite direction, and including:

a low profile frame comprising, an elongated planar base member to be transversely superimposed upon a pavement surface over which vehicular traffic is to pass, a pair of spaced rails extending longitudinally of the base member, and opposite ramp members extending longitudinally of the base member and inclined thereover between the opposite edges thereof and the spaced rails respectively, there being a shallow upwardly open channel between said rails;

and a plurality of modules selectively replaceable in a series along the rails of said frame and including barrier modules comprising, a slotted mounting plate secured to the rails and disposed in a plane extending between the said opposite ramp members, a barrier blade assembly journaled on spaced trunnions depending into said frame channel and with at least one barrier blade depressible through the mounting plate slotted therefor, and spring means extending from a lever point on the barrier blade assembly to the mounting plate and yieldingly urging the barrier blade assembly into stopped engagement with the mounting plate to be visibly exposed thereabove for vehicle control.

8. The traffic controller as set forth in claim 7, wherein the plurality of selectively replaceable modules includes at least one cover module comprised of a plate secured to the rails in place of the aforesaid barrier modules and disposed in a plane extending between the said opposite ramp members.

9. The traffic controller as set forth in claim 7, wherein each barrier blade assembly comprises a mounting bar rotatable in the said spaced trunnions, and at least one barrier blade carried thereby through the slotted mounting plate.

10. The traffic controller as set forth in claim 7, wherein each barrier blade assembly comprises a mounting bar rotatable in the said spaced trunnions, and at least one barrier blade carried thereby and extending through a complementary slot in the mounting plate and having stopped engagement therein when extended.

11. The traffic controller as set forth in claim 7, wherein the spring means comprises a pair of identical tension springs extending divergently to equidistant anchor points on the mounting plate and thereby positionably balancing the barrier blade assembly axially between the said spaced trunnions.

12. The traffic controller as set forth in claim 7, wherein the barrier blade assembly comprises a mounting bar rotatable in the said spaced trunnions, and several barrier blades carried thereby to extend through complementary slots in the mounting plate, and wherein the spring means comprises a pair of identical tension springs extending diagonally from said lever point at a central barrier blade to equidistant anchor points on the mounting plate and thereby positionably balancing the barrier assembly axially between said spaced trunnions.

13. An above-grade vehicle traffic controller permitting traffic flow in one direction while preventing traffic flow in the opposite direction, and including:

a low profile support to be transversely superimposed upon an existent framework disposed in a plane coincidental with a pavement surface over which vehicular traffic is to pass and comprising, a pair of spaced rails secured to said existent framework, there being an upwardly open channel recess between said secured rails;

and a plurality of modules selectively replaceable in a series along the rails and including barrier modules comprising, a slotted mounting plate secured to the rails in a supporting plane and having opposite ramps, a barrier blade assembly journaled on spaced trunnions depending into said channel recess and with at least one barrier blade depressible through the mounting plate slotted therefor, and spring means extending from a lever point on the barrier blade assembly to the mounting plate and yieldingly urging the barrier blade assembly into stopped engagement with the mounting plate to be visibly exposed thereabove for vehicle control.

14. The traffic controller as set forth in claim 13, wherein the plurality of selectively replaceable modules includes at least one cover module comprised of a plate secured to the rails in place of the aforesaid barrier modules and disposed in said supporting plane and having opposite ramps.

15. The traffic controller as set forth in claim 13, wherein each barrier blade assembly comprises a mounting bar rotatable in the said spaced trunnions, and at least one barrier blade carried thereby through the slotted mounting plate.

16. The traffic controller as set forth in claim 13, wherein each barrier blade assembly comprises a mounting bar rotatable in the said spaced trunnions, and at least one barrier blade carried thereby and extending through a complementary slot in the mounting plate and having stopped engagement therein when extended.

17. The traffic controller as set forth in claim 13, wherein the spring means comprises a pair of identical tension springs extending divergently to equidistant anchor points on the mounting plate and thereby positionably balancing the barrier blade assembly axially between the said spaced trunnions.

18. The traffic controller as set forth in claim 13, wherein the barrier blade assembly comprises a mounting bar rotatable in the said spaced trunnions, and several barrier blades carried thereby to extend through complementary slots in the mounting plate, and wherein the spring means comprises a pair of identical tension springs extending diagonally from said lever point at a central barrier blade to equidistant anchor points on the mounting plate and thereby positionably balancing the barrier assembly axially between said spaced trunnions.

* * * * *